US008591179B2

(12) United States Patent
Clemen

(10) Patent No.: US 8,591,179 B2
(45) Date of Patent: Nov. 26, 2013

(54) AXIAL-FLOW COMPRESSOR WITH A FLOW PULSE GENERATOR

(75) Inventor: Carsten Clemen, Mittenwalde (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 749 days.

(21) Appl. No.: 12/836,363

(22) Filed: Jul. 14, 2010

(65) Prior Publication Data

US 2011/0014037 A1 Jan. 20, 2011

(30) Foreign Application Priority Data

Jul. 17, 2009 (DE) ..... 10 2009 033 754

(51) Int. Cl.
*F01D 25/24* (2006.01)

(52) U.S. Cl.
USPC ..... 415/159; 415/914

(58) Field of Classification Search
USPC ..... 415/159, 173.1, 183, 185, 202, 191, 415/209.2, 914
See application file for complete search history.

(56) References Cited

U.S. PATENT DOCUMENTS 3,879,939 A * 4/1975 Markowski ..... 60/751
4,571,937 A * 2/1986 Albers ..... 60/806
7,575,412 B2 * 8/2009 Seitz ..... 415/58.5
7,665,964 B2 * 2/2010 Taylor et al. ..... 415/194
7,967,556 B2 * 6/2011 Gummer ..... 415/144
2010/0284795 A1 * 11/2010 Wadia et al. ..... 415/173.1

FOREIGN PATENT DOCUMENTS

DE 102006048933 4/2008
EP 0042044 12/1981
JP 56069404 A * 6/1981

OTHER PUBLICATIONS

Translation of JP 56069404.*
German Search Report dated Jan. 10, 2012 from counterpart application.

* cited by examiner

*Primary Examiner* — Nathaniel Wiehe
*Assistant Examiner* — Ryan Ellis
(74) *Attorney, Agent, or Firm* — Timothy J. Klima; Shuttleworth & Ingersoll, PLC

(57) ABSTRACT

Axial-flow compressor including, within a compressor casing (4), at least one rotor (2) of rotor blades (3) connected to a drive shaft (1) and a stator (5) held on the casing inner wall and, associated to the rotor gap (6) between the blade tips and the casing inner wall, a flow pulse generator (7) for stabilizing the rotor gap flow, characterized in that the flow pulse generator (7) includes pulse channels (7*a*) arranged on the inner wall of the casing and extending upstream of the rotor (2) and tapering in flow direction to accelerate the wall-near flow (9), with the shape and size of the pulse channels (7*a*) being determined by circumferentially spacedly disposed, successive separators (7*b*) attached without gap on the compressor casing inner wall. The flow pulse generator (7) so designed, which is easily manufacturable, improves the stabilization of the rotor gap (6) flow, extends the operating range of the compressor and increases the surge limit.

12 Claims, 3 Drawing Sheets

AXIAL-FLOW COMPRESSOR WITH A FLOW PULSE GENERATOR

Figure 1:
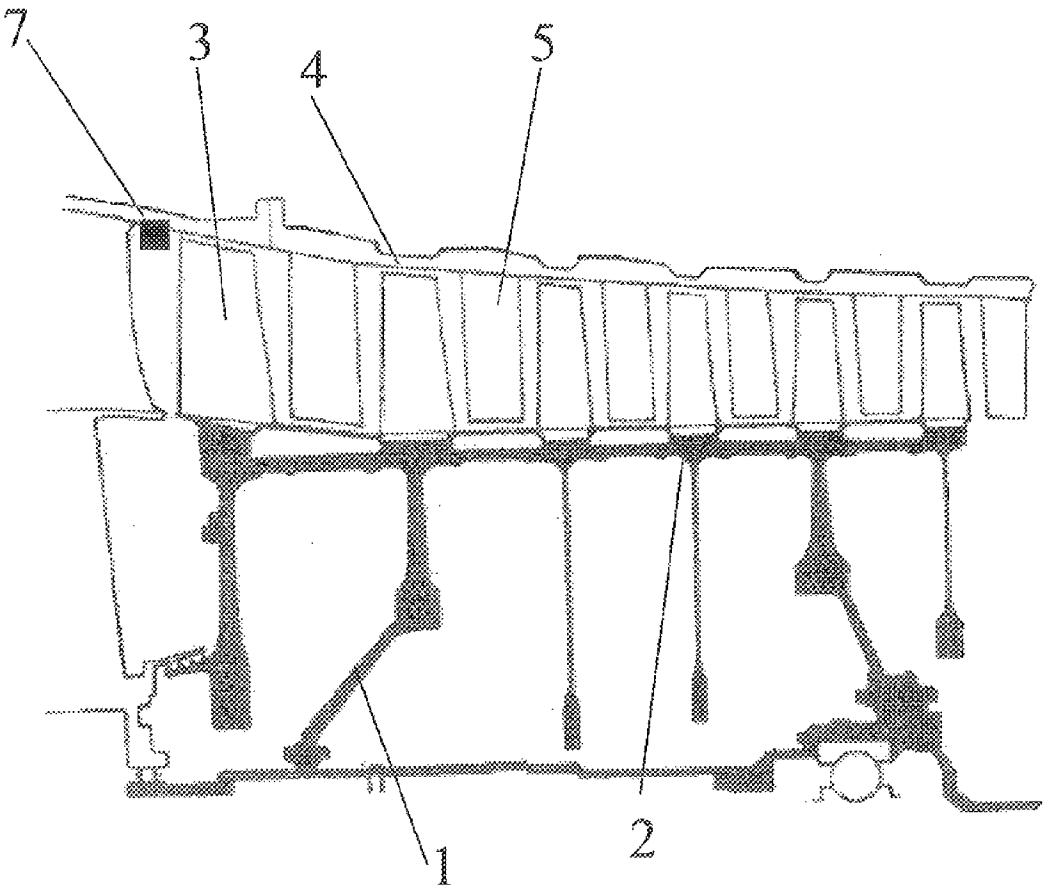

This invention relates to an axial-flow compressor including, within a compressor casing, at least one rotor of rotor blades connected to a drive shaft and a stator held on the casing inner wall and, associated to the rotor gap between the blade tips and the casing inner wall, a flow pulse generator for stabilizing the rotor gap flow.

On axial-flow compressors, flow instabilities limiting its operating range may occur in the area of the rotor gap between the rotor blade tips and the compressor casing under high load, for example during strong acceleration of aircraft powered by a gas-turbine engine. A flow pulse generated on the rotor gap enables the gap swirl, which is critical at high compressor load, to be stabilized and, consequently, the operating range of the compressor extended or, respectively, the operating stability thereof improved.

According to a known measure for actively influencing compressor stability, compressed fluid is tapped from the rearward stages of the compressor and re-introduced in the blade tip area of the forward rotors to increase the flow pulse on the gap and thereby actively influence the rotor gap flow and stabilize the gap swirl. However, this process is disadvantageous in that the re-introduction of hot fluid from the rearward section of the compressor increases the temperature of the fluid in the compressor and, consequently, decreases compressor efficiency.

Compressor stability is also passively influencable by indentations provided in the compressor casing above the blade tips. A flow circulation effected by the indentation conveys a certain amount of energy into the forward area of the rotor tip, so that the pulse of the rotor inflow is increased and thus the rotor gap flow and ultimately compressor operation are stabilized. Apart from the fact that re-circulation of a certain fluid quantity also in this process entails an increase in temperature, this casing design is difficult to manufacture and is also liable to damage as the rotor rubs in.

In a broad aspect, the present invention provides, with regard to the flow pulse generator, for the development of an axial-flow compressor of the type specified at the beginning such that, with reduced manufacturing investment and without wear, a high local flow pulse for stabilizing rotor gap flow and compressor operation is achieved.

It is a particular object of the present invention to provide a solution to the above problems by an axial-flow compressor designed in accordance with the features described herein. Advantageous developments and useful embodiments of the present invention will become apparent from the present description.

The present invention, in its essence, provides a flow pulse generator arranged on the inner wall of the compressor casing and including pulse channels extending upstream of the rotor and tapering in flow direction to accelerate the wall-near flow. The shape and size of the pulse channels directed towards the rotor gap is established by circumferentially spacedly disposed, successive separators attached without gap on the casing inner wall. The flow pulse generator so designed is easily manufacturable and ensures favourable inflow of the rotor gap and effective stabilization of the rotor gap flow. The operating range of the compressor is extended without impairing compressor efficiency.

In a further development of the present invention, the pulse channels are each confined by opposite sidewalls of the separators. The sidewalls have an aerodynamically favourable—straight and/or curved—contour. The upstream inflow geometry of the separators is also aerodynamically favourable.

In development of the present invention, the pulse channels feature a rectangular cross-section. The inlet cross-sections of the pulse channels are approximately twice their exit cross-sections.

In an advantageous further development of the present invention, the separators are covered towards the casing interior by a thin partition separating them from the main flow to the rotors. The partition can extend axial-parallelly in flow direction or follow the contour of the wall of the compressor casing.

In a further development of the present invention, the pulse channels and separators have a radial height which—at most—is twice the width of the rotor gap. The length of the pulse channels and separators in axial direction is between 10 and 100% of the chord length at the rotor blade tip.

The pulse channels and separators terminate at a distance to the leading edge of the rotor blades which is between 10 and 100% of the length of the chord at the rotor blade tip.

In a further development of the present invention, two or more pulse channels are provided for each rotor blade passage situated between two rotor blades.

Figure 3:
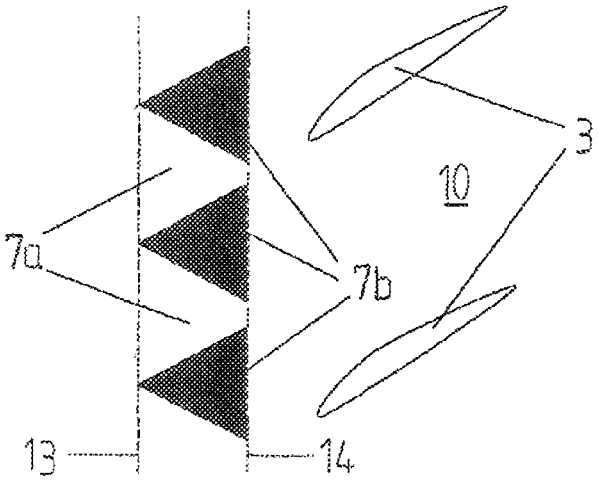
Figure 4:
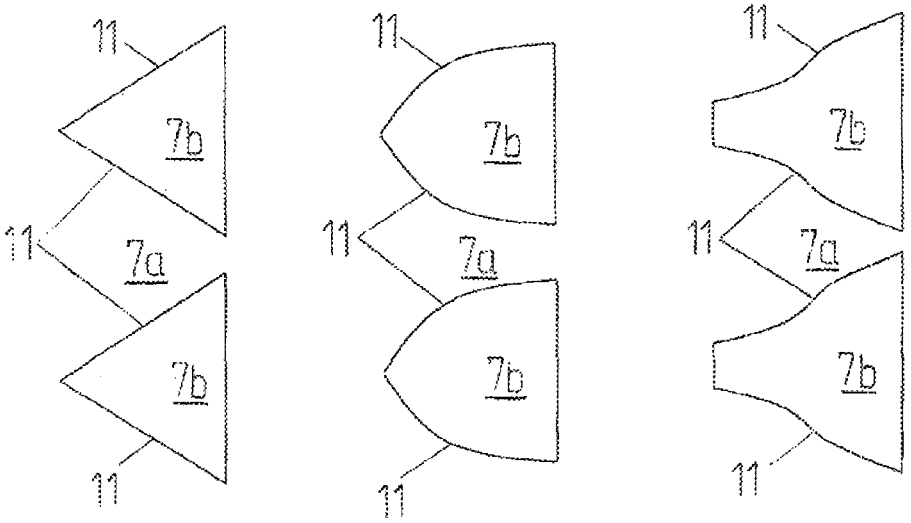

The present invention is more fully described in light of the accompanying drawing showing a preferred embodiment. In the drawing, FIG. 1 is a longitudinal section of an axial-flow compressor for an aircraft gas turbine, FIG. 2 is a schematic representation of a flow pulse generator arranged at the compressor casing upstream of the rotor, FIG. 3 is a top view of the flow pulse generator as per FIG. 2, and FIG. 4 shows different variants of flow generators in top view.

FIG. 1 shows an axial-flow compressor, as used on a gas-turbine engine, which includes several rotors 2 assembled to a rotor drum and connected to a drive shaft 1, as well as stators 5 arranged between the rotor blades 3 and held on the compressor casing 4. A flow pulse generator 7 attached to the inner wall of the compressor casing 4 is associated to the front rotor 2 upstream of and at a certain distance from the rotor gap 6 between the blade tips and the compressor casing 4.

Figure 2:
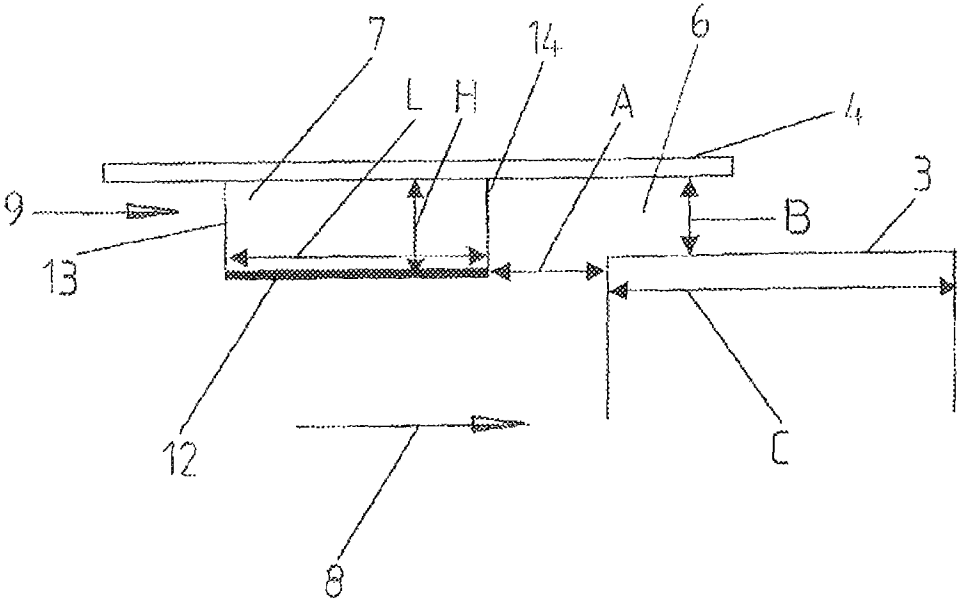

FIG. 2 shows that the flow pulse generator 7 is arranged in—compared with the main flow 8—a wall-near area of low flow velocity 9 at a distance A between the trailing edge 14 of the flow pulse generator 7 and the leading edge of the rotor blades 3. Distance A and length L of the flow pulse generator 7 are approx. 10 to 100% of the chord length C of the rotor blades 3 measured at the blade tip. As the flow pulse generator 7 immediately adjoins the compressor casing 4, there is no air gap between them. Height H of the flow pulse generator is not more than twice the width B of the rotor gap 6.

The flow pulse generator 7 includes a plurality of circumferentially spacedly arranged pulse channels 7*a* tapering in flow direction and being established by separators 7*b* provided on the compressor casing 4 and shaped in accordance with the shape of the pulse channels 7*a*. In the embodiment shown in FIG. 3, two flow pulse generators 7, i.e. two pulse channels 7*a*, are provided for each rotor blade passage 10. However, three or four pulse channels 7*a* may also be associated with a blade passage 10. The separators 7*b*, which are confined by sidewalls 11 and radially inwards by a thin partition 12, here have a triangular cross-sectional area, with the sidewalls 11 confining the pulse channel 7*a* having a straight or convexly or concavely curved contour (FIG. 4) to enable diversely formed, tapering and aerodynamically favourable pulse channels 7*a* to be provided. The cross-sectional area of the pulse channels 7*a* is preferably rectangular, and the inlet cross-section should be approximately twice the exit cross-section. As regards the vertical cross-sectional area and the shape of the partition 12, the separators 7*b*, and thus the pulse channels 7*a*, are preferably formed such that their contour follows the contour of the compressor casing 4. The leading edge 13 of the separators 7*b* is of an aerodynamically favourable design.

The flow pulse generators 7 described above are easily manufacturable. Wear or damage as the rotor blades 3 rub in is not to be feared, and compressor efficiency is not affected by increased fluid temperature. Furthermore, the flow pulse is specifically adaptable to the respective flow conditions via the shape, size, contour, number and disposition of the pulse channels 7*a*, thereby extending the operating range of the axial-flow compressor and increasing the surge limit.

LIST OF REFERENCE NUMERALS

1 Drive shaft
2 Rotors
3 Rotor blades
4 Compressor casing
5 Stators
6 Rotor gap
7 Flow pulse generator
7*a* Pulse channels
7*b* Separators
8 Main flow
9 Area of low flow velocity
10 Rotor blade passage
11 Sidewall of 7*b*
12 Partition of 7*b*
13 Leading edge of 7*b*
14 Trailing edge of 7*b*
A Distance between 3 and 7
B Width of 6
H Height of 7
L Length of 7
S Chord length of 3

What is claimed is:

1. An axial-flow compressor including, within a compressor casing, at least one rotor of rotor blades connected to a drive shaft;

a stator held on an inner wall of the casing and, a flow pulse generator for stabilizing a rotor gap flow associated with a rotor gap formed between tips of the rotor blades and the casing inner wall, the flow pulse generator including pulse channels arranged on the inner wall of the casing and extending upstream of the rotor and tapering in a flow direction to accelerate a wall-near flow, a shape and size of the pulse channels being determined by circumferentially spaced successive separators attached without a gap on the casing inner wall, the flow pulse generator radially aligned with and positioned directly upstream of at least a portion of the rotor gap to accelerate a wall-near flow into the rotor gap.

2. The axial-flow compressor of claim 1, wherein the pulse channels are each confined by opposite sidewalls of adjacent separators.

3. The axial-flow compressor of claim 1, wherein the pulse channels include a rectangular cross-section.

4. The axial-flow compressor of claim 1, wherein inlet cross-sections of the pulse channels are approximately twice exit cross-sections of the pulse channels.

5. The axial-flow compressor of claim 1, wherein the separators are covered towards a casing interior by a thin partition separating them from the main flow to the rotors.

6. The axial-flow compressor of claim 5, wherein the partition extends at least one chosen from axially parallel to a flow direction and following a contour of the inner wall of the compressor casing.

7. The axial-flow compressor of claim 1, wherein the pulse channels and separators have a radial height (H) which is no greater than twice a width (B) of the rotor gap.

8. The axial-flow compressor of claim 1, wherein a length (L) of the pulse channels and separators in an axial direction is between 10 and 100% of a chord length (C) at the rotor blade tip.

9. The axial-flow compressor of claim 1, wherein the pulse channels and separators terminate at a distance (A) to a leading edge of the rotor blades which is between 10 and 100% of a chord length (C) at the rotor blade tip.

10. The axial-flow compressor of claim 1, wherein at least two pulse channels are provided for each rotor blade passage situated between two adjacent rotor blades.

11. The axial-flow compressor of claim 7, wherein a length (L) of the pulse channels and separators in an axial direction is between 10 and 100% of a chord length (C) at the rotor blade tip.

12. The axial-flow compressor of claim 11, wherein the pulse channels and separators terminate at a distance (A) to a leading edge of the rotor blades which is between 10 and 100% of a chord length (C) at the rotor blade tip.

* * * * *